US005097566A

United States Patent [19]

Decker et al.

[11] Patent Number: 5,097,566

[45] Date of Patent: Mar. 24, 1992

[54] SLIP-RESISTANT CUSHIONING COVERS FOR HANDLES

[75] Inventors: Richard B. Decker, Vermilion; Joseph Hummel, Amherst, both of Ohio

[73] Assignee: Bettcher Industries, Inc., Birmingham, Ohio

[21] Appl. No.: 720,607

[22] Filed: Jun. 25, 1991

Related U.S. Application Data

[63] Continuation-in-part of Ser. No. 544,130, Jun. 25, 1990, abandoned, which is a continuation-in-part of Ser. No. 106,247, Oct. 7, 1987, Pat. No. 4,941,232.

[51] Int. Cl.[5] ..... B25G 1/10

[52] U.S. Cl. ..... 16/111 R; 16/114 R; 16/DIG. 12; 74/551.9; 273/75; 273/81 B; 273/81.4; 30/276; 81/489

[58] Field of Search .... 16/111 R, DIG. 12, DIG. 19, 16/114 R, 116 R; 273/75, 81 B, 81 D, 81 R, 81.4; 74/551.9

[56] References Cited

U.S. PATENT DOCUMENTS 2,655,963 10/1953 Dell .
4,098,506 7/1978 Gaiser .
4,685,189 8/1987 Palmqvist et al. .
4,702,006 10/1987 McCullough .
4,785,495 11/1988 Dellis .

FOREIGN PATENT DOCUMENTS 2805315 8/1979 Fed. Rep. of Germany .
2857022 5/1980 Fed. Rep. of Germany .
416791 5/1910 France .
2573315A 5/1986 France .
WO86/02849 5/1986 PCT Int'l Appl. .
630295 10/1949 United Kingdom .
2124089A 2/1984 United Kingdom .
2185209A 7/1987 United Kingdom .

*Primary Examiner*—Robert L. Spruill
*Assistant Examiner*—Carmine Cuda
*Attorney, Agent, or Firm*—Watts Hoffmann Fisher & Heinke

[57] ABSTRACT

A slip-resistant, flexible, cushioning cover for a handle, formed of an elastomeric tube having at least one open end, said tube having ribs on an outside surface. The ribs each have sidewalls extending from the outside surface, and a top wall extending between the sidewalls, forming an outer surface of the ribs. The outer surface of the ribs is concave and the junctures of the top surface and the sidewalls have sharp edges.

47 Claims, 4 Drawing Sheets

SLIP-RESISTANT CUSHIONING COVERS FOR HANDLES

CROSS REFERENCE TO RELATED APPLICATION

This application is a Continuation-in-Part of copending application Ser. No. 07/544,130 filed June 25, 1990, now abandoned, which is a Continuation-in-Part of application Ser. No. 07/106,247, filed Oct. 7,1987, now U.S. Pat. No. 4,941,232.

TECHNICAL FIELD

This invention relates to improved slip-resistant covers for handles and especially for handles of meatcutting knives.

BACKGROUND ART

It is often desirable to apply a cushion-like covering to an otherwise rigid handle of an implement for improved comfort and grip. However, constructions and materials used in existing grips, especially those that can be applied and replaced by the user, are not satisfactory for many applications. In the food industry, in particular, a satisfactory slip-resistant replaceable handle cushion is needed for knives and other tools.

Health standards in the food industry, especially the meat butchering and cutting industry, dictate a high degree of cleanliness and cleanability for equipment, including knives and other cutting tools, both hand operated and power driven. As a result, the materials used to fabricate the tools are typically non-porous, such as stainless steel, aluminum, or plastic, to minimize the foci where soil can accumulate. Power-driven hand knives, for example, typically have smooth metal or plastic handles with, perhaps, a small knurled portion to facilitate gripping by the user. The fluids and fats which result from cutting meat or other comestibles lead to slipperiness between the meat-cutter's hand or glove and the cutting tool handle.

Power tools compound the problem of slippage by contributing motor vibrations, sudden torque, and mechanical shock which can jar the tool from the operator's hand. The vibration also causes fatigue and discomfort that makes gripping the tool more difficult. Typically an operator tends to grip a slippery or vibrating tool more firmly by applying more hand pressure, which leads to operator fatigue.

DISCLOSURE OF THE INVENTION

The invention is a tubular elastomeric covering constructed to be applied to a handle by the user of a hand-held or gripped object and constructed to be readily removable for cleaning and replacement. The covering is characterized by a non-slip surface to facilitate hand gripping under moist or oleaginous conditions; resilience sufficient to provide cushioning against mechanical shock and vibration being transmitted from the handle to the hand during use; reversible adherence to the handle to provide for non-twisting of the cover during use of the handle and further to provide for removal or replacement of the cover after use; elasticity sufficient to provide for dimensional modification of the cover so that it contacts substantially the entire surface of the handle; non-permeability to prevent fluid substances from passing through the cover to the handle; and low thermal conductivity to provide insulation against heat being conducted away from the hand to the handle during use.

A preferred embodiment of the cover is in the form of a thin, ribbed, tubular sheath. The cover is applied to the handle by the user by unrolling a rolled-up cover onto the handle. The cover may be of many shapes, e.g., cylindrical, frusto-conical or hourglass shaped, depending upon the elasticity of the cover and the configuration of the handle to which it is applied. The thin, ribbed, cover is formed by dipping a grooved form or matrix into liquified elastomeric material, such as latex. Once the elastomeric material has set, it is stripped off the matrix and turned inside out to form the ribbed tubular sheath.

The invention, in a preferred embodiment, is comprised of a slip-resistant, flexible, cushioning cover for a handle, formed of an elastomeric tube open at one or both ends, said tube having ribs on an outside surface. The ribs each have sidewalls extending from the outside surface and a top wall extending between the sidewalls, forming an outer surface of the ribs. The top wall of the ribs is concave and the junctures of the top wall and the sidewalls have sharp edges.

In order for the thin, ribbed, cover to be applied to a handle, especially a metallic handle, it is advantageous for the cover to be rolled up into a toroid shape and then accurately unrolled onto the handle. This is because the elastomeric nature of the cover prevents it from being slidable over the handle. It is undesirable to fabricate the cover so that it could be slipped over the handle or to lubricate it for application because in either case, the cover would twist during use and present a safety hazard. Thus, once the cover is on the handle, it adheres and cannot be positionally adjusted. A fixture, as disclosed in copending application Ser. No. 07/106,247, aids in the application of the cover so it can be placed in a desired position and unrolled onto the handle.

Another preferred embodiment of the cover of the present invention is in the form of an elongated hollow tube open at one or both ends, the tube being formed by a wall that varies in thickness along the length of the tube, an inside surface of the wall being essentially formed of straight-line elements so as to fit onto a conventional handle of cylindrical or tapered shape, and an outside surface of the wall has an undulating contour along its length to provide a desired gripping contour. The tube has integral ribs on the outside surface of the wall. The ribs each have sidewalls and a top wall that extends between the sidewalls, forming an outer surface. The top wall is concave and the junctures of the top wall and the sidewalls have sharp edges. The contoured-wall, ribbed, cover is formed by being cast from a mold. The thickness of the contoured wall can be varied to change the grip size so that thicker-walled covers would be used by an operator with a larger hand and thinner-walled covers by an operator with a small hand. The contoured-wall cover is applied to the handle by slipping the cover over the handle. The cover is rigid enough to be slidable over the handle and the elastomer is sufficiently adherent that the cover will not twist relative to the handle during use.

A handle, such as that of a meat trimming knife, covered with a ribbed cover as described, is comfortable to grip and not likely to slip from the user's hand.

The above and other features and advantages of the invention will become more apparent from the detailed description that follows.

BEST MODE FOR CARRYING OUT THE INVENTION

Figure 2:
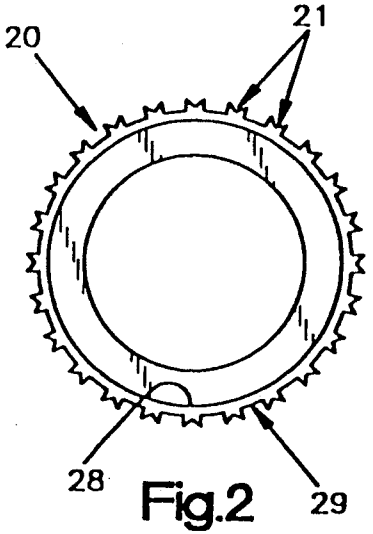
FIGS. 2 and 8 are end elevational views of the covers of FIGS. 1 and 7, respectively.
Figure 1:
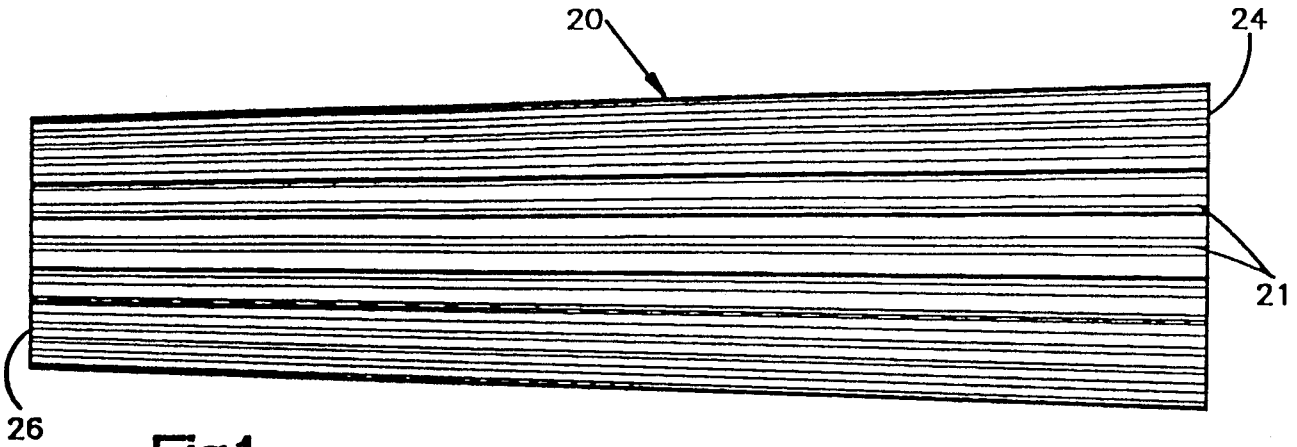
FIGS. 1 and 7 are elevational views of two different embodiments of a thin, ribbed cover constructed to be applied to a handle and embodying the present invention.
Figure 3:
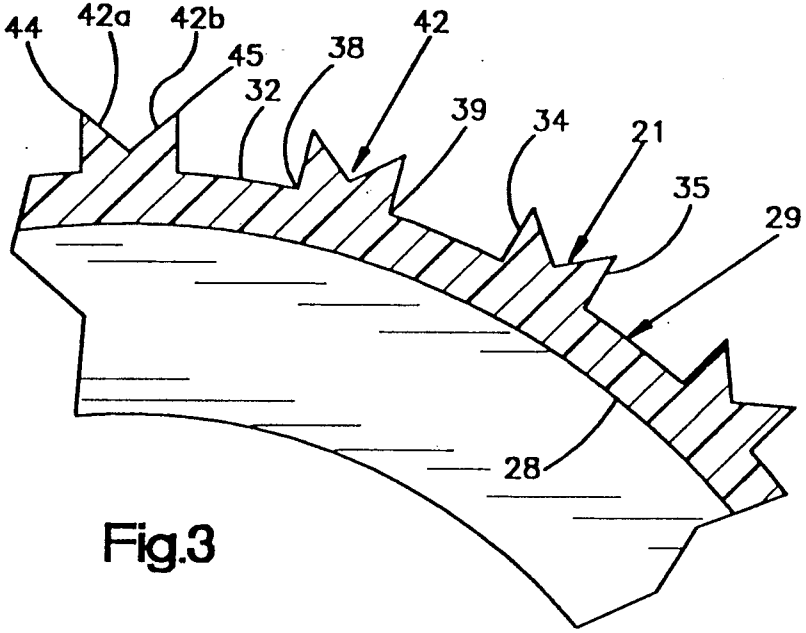
FIGS. 3 and 9 are enlarged partial sectional views of the portions of the covers marked by a circle in FIGS. 2 and 7, respectively.

Referring to the drawings, a thin, ribbed, cover of a type suitable to be applied to a handle and embodying the invention is shown generally at 20 in FIG. 1. The cover is formed by dipping a grooved form or matrix into liquified elastomeric material such as Surtex Natural Rubber Latex, which is natural rubber latex, U.S.-D.A. approved, and stripping the set latex cover off the matrix inside out to yield the cover 20. The grooves on the matrix are longitudinal and suitably shaped to form the longitudinal ribs 21 on the outside of the cover.

The tubular cover 20 is open at two opposite ends 24, 26. In the preferred embodiment shown, the ends are circular as formed and the end 24 is of larger diameter than the end 26, the inside and outside surfaces 28, 29 are formed of straight-line elements, and the cover is longer than the diameter of the end 24.

The ribs 21 are equally spaced about the periphery of the cover and extend equal distances radially from the inside surface 28. The inside surface 28 is smooth The outside surface 29 is formed of base surface portions 32 between adjacent ribs 21; radial walls 34, 35 that form opposite side walls of each rib and that 1 form junctures 38, 39 with the base surface portions 32; and top walls or surfaces 42 that extend between the side walls the full length of the ribs. The radial walls are flat and uniformly spaced from each other along the length of the ribs. The top walls or surfaces are concave so as to form sharp junctures 44, 45 with the sidewalls 34, 35, meeting at less than a 90 degree angle with the adjacent side wall. In the preferred embodiment shown, the sharp junctures have a radius of no more than 0.005 inch. Also in the preferred embodiment shown, the top walls or surfaces are each formed by two flat wall portions 42*a*, 42*b* that meet midway between the sidewalls 34, 35 at a 90 degree angle.

To provide an especially effective grip, it is preferred that the spaces between adjacent ribs, which are formed by the base surface portions 32, be of greater dimension in the circumferential direction than the circumferential thickness of the ribs (i.e., the distance between the walls 34, 35 of a rib) and that the height of the ribs (i.e., the radial dimension of the sidewalls) from the surface portions 32 be no greater than and preferably less than the circumferential thickness of the ribs so the ribs will have good resistance to peripheral distortion under torque. In a preferred embodiment, the height of the ribs is 2/3 the circumferential thickness.

An especially suitable material that provides the desirable characteristics of the cover, as set forth previously, is natural rubber, i.e., latex. It has been found that 35 Durometer natural rubber is especially suitable.

Figure 6:
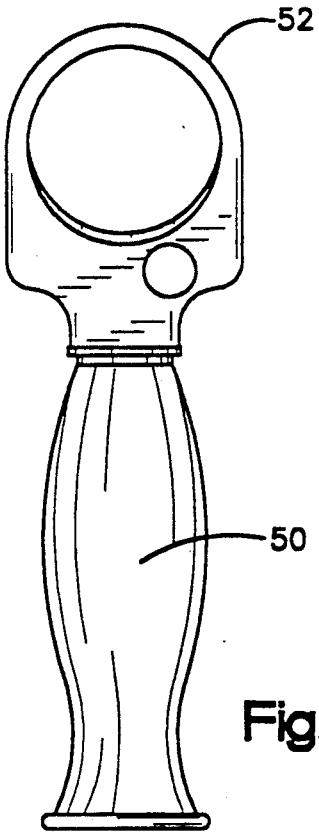
FIG. 6 is an elevational view of a power driven knife with a contoured handle, of a type on which the covers of FIGS. 1 and 7 are adapted to be used.
Figure 8:
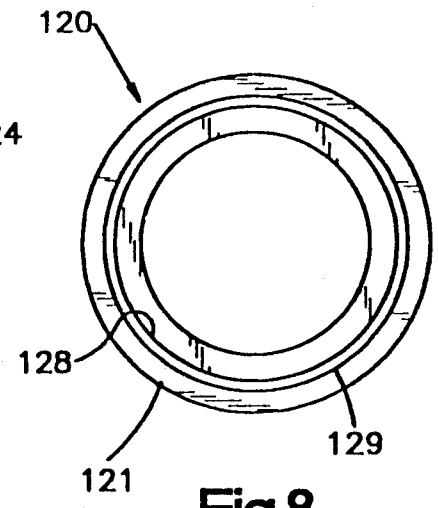

Because the elastomeric material of which the cover is made readily stretches and returns to its original dimensions, the diameter or circumferential dimensions should be chosen so the cover is in a stretched condition peripherally when applied to a handle. This and a relatively high coefficient of friction of the cover material assure a high resistance to slippage between the cover and the handle to which it is applied. As a result, a cover of the general shape shown in FIG. 1 can be applied to a handle that is of different shape from the cover, e.g., a handle 50 of the so-called "hour-glass" shape provided on a power-driven knife 52, shown in FIG. 6, as long as the variations in handle diameter along the length of the handle do not exceed the ability of the cover material to stretch sufficiently to both accommodate the largest diameter portion and to be under tension over the smallest diameter portion.

To assure flexibility yet adequate strength for the cover, when made of thin elastomeric material that will readily conform to the contour of a handle to which the cover is applied, the wall thickness of the cover at the base surface portions 32 is no less than 75% of the height of the ribs and typically is no greater than the height of the ribs.

By way of example, a suitable cover 20 with good resisting torque when gripped under wet and greasy conditions, has been constructed that is 4½ inches in length, has an inside diameter at a larger end of 1.13 inches, an inside diameter at a smaller end of 0.82 inch, a thickness at the base surface portions 32 of 0.03 to 0.04 inch, and twenty-four equally spaced ribs that extend radially beyond the surface portions 32 a distance of 0.04 inch and that are 0.06 inch wide.

It has been found that the transversely concave top walls or surfaces 42 of the ribs provide a marked improvement in the ability to apply or resist torque when the cover 20 is gripped under greasy conditions, as compared with a similar cover in which the ribs have flat top walls or surfaces; the improvement being on the order of 50%. It is believed that the large improvement is attained under such conditions because the concave surfaces 42 and the sharp junctures 44, 45 result in an effective squeegee action on the gripping surface of the hand, allowing a better grip on the handle to which the cover is applied, as compared to a cover having flat top surfaces on the ribs.

Figure 4:
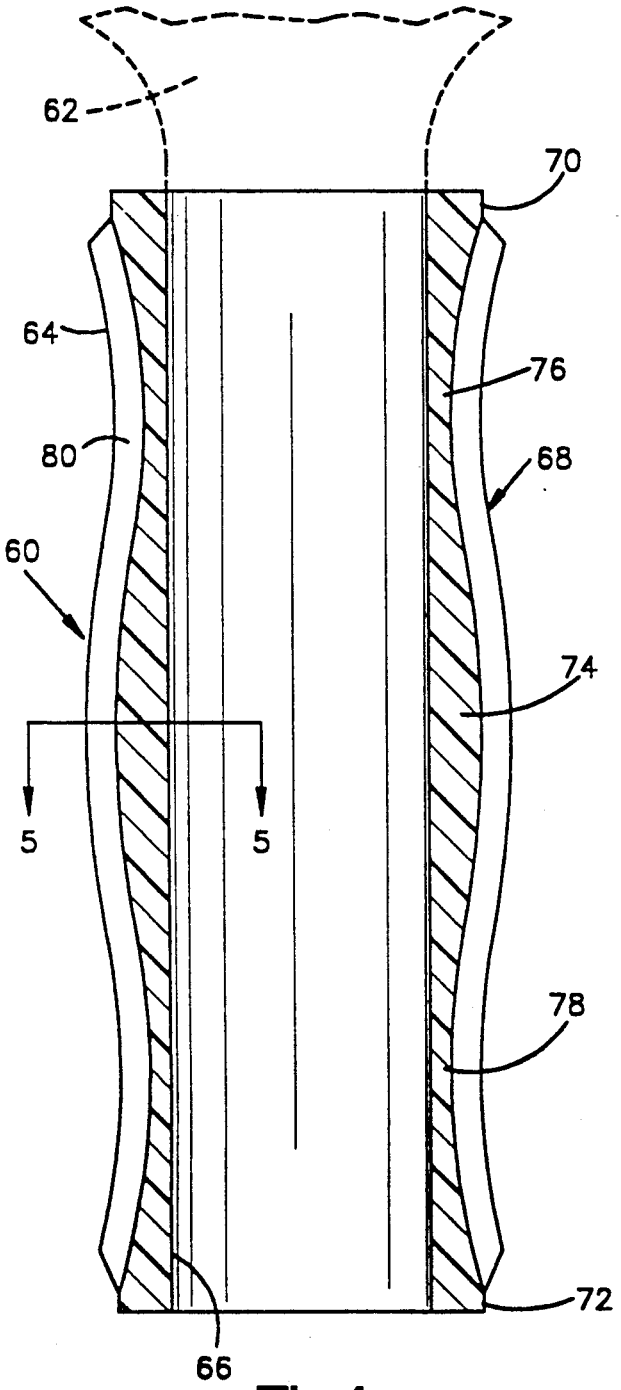
FIGS. 4 and 10 are longitudinal sectional views of two additional embodiments of a cover constructed in accordance with the present invention.
Figure 5:
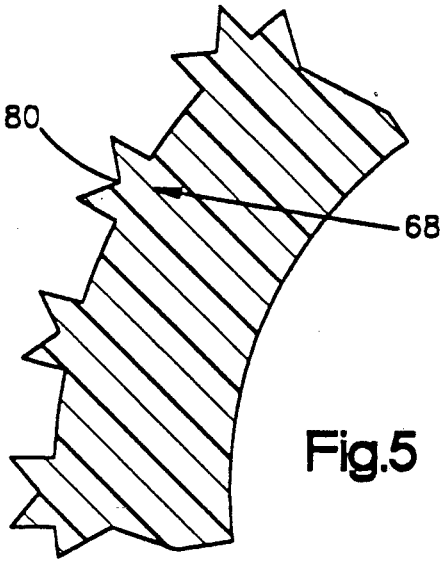
FIGS. 5 and 11 are enlarged partial cross sectional views of portions of the covers of FIG. 4 (taken along the line 5—5) and FIG. 10 (marked by a circle), respectively.

The contoured-wall, ribbed, cover of the invention is shown generally at 60 on a handle 62 shown in phantom in FIG. 4. The contoured-wall cover is formed by molding liquified elastomeric material in a contoured-wall-cover-forming mold. The elastomeric material may be a natural rubber latex, such as Surtex Natural Rubber Latex which is U.S.D.A. Approved. The exterior surface 64 of the contoured-wall cover 60 is of the so-called hour-glass shape while the interior surface 66 is shaped to fit closely on the handle 62, which is cylindrical in shape in the embodiment shown. The hour-glass-like shape of the exterior surface 64 is formed by varying the thickness of a solid wall portion 68 from about ¼" at one end 70 and the other end 72 to about ⅜" at the hour-glass bulge 74 about half way between the ends, with a thickness of about ⅛" at a first waist 76 and at a second waist 78 on opposite sides of the bulge. Longitudinal ribs, as at 80, are substantially of the same shape, relative spacing and height above base space portions, as the ribs 21. The contoured-wall cover 60 is sufficiently rigid to be slipped over and onto a handle, such as the handle 62. One advantage of the hour glass shape is that the thickness of the bulge 74 at the middle may be varied to accommodate different operator hand sizes for the same diameter handle. Another advantage of the hour-glass shape is the provision of a relatively thick, i.e., about 1/8 of an inch at the thinnest waist portions, layer of elastomeric material beneath the ribs 80 to enhance the cushioning and shock absorbency of the cover.

Figure 7:
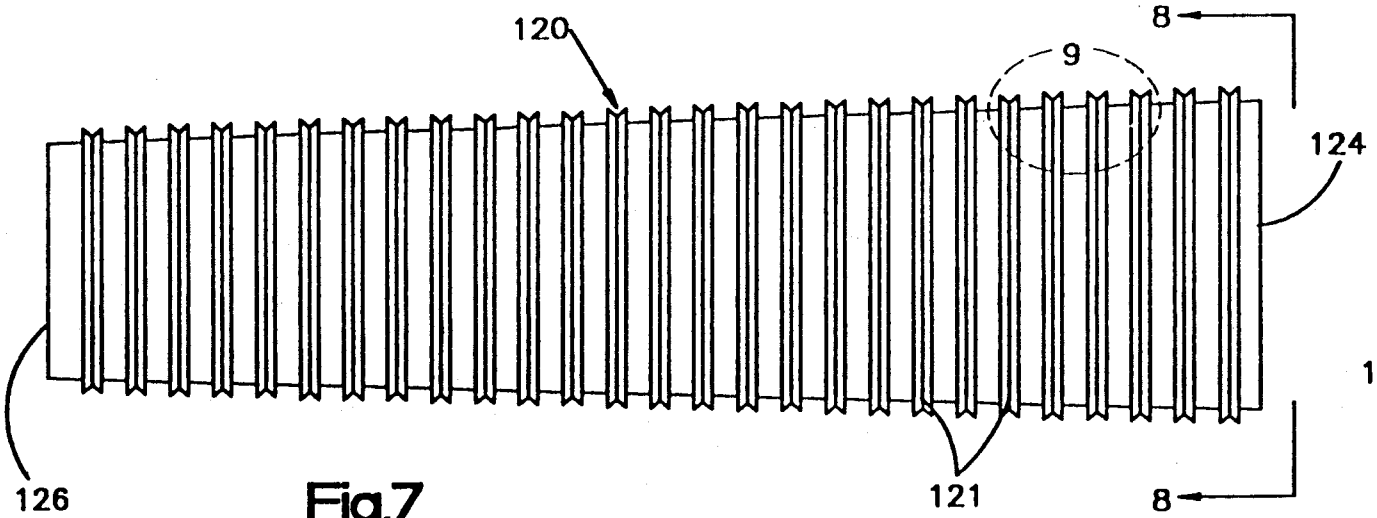
Figure 9:
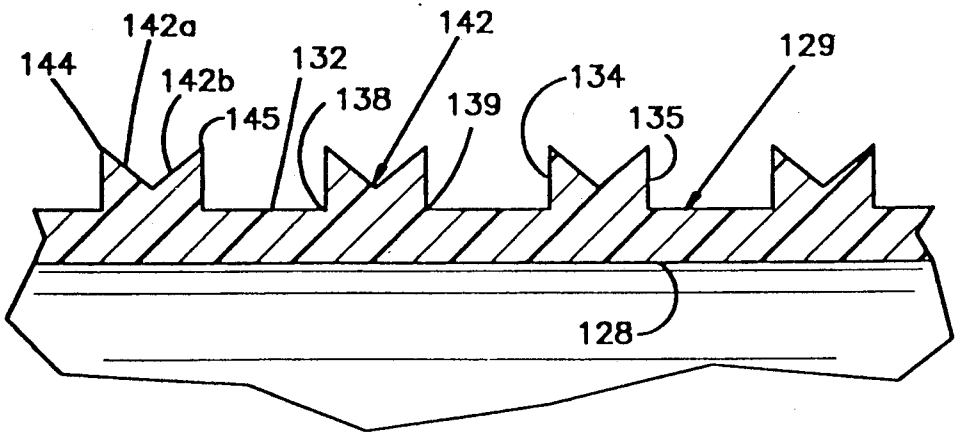

A further embodiment of a thin, ribbed, cover of a type suitable to be applied to a handle and embodying the invention is shown generally at 120 in FIG. 7. The cover is formed in the same manner as the cover 20. In this case, however, the grooves on the matrix are circumferential and suitably shaped to form the circumferential ribs 121 on the outside of the cover.

The tubular cover 120 is open at two opposite ends 124, 126. In the preferred embodiment shown, the ends are circular as formed and the end 124 is of larger diameter than the end 126, and the inside surface 128 is formed of straight-line elements, and the cover is longer than the diameter of the end 124.

The ribs 121 are equally spaced along the length of the cover and extend equal distances radially from the inside surface 128. The inside surface 128 is smooth. The outside surface 129 is formed of base surface portions 132 between adjacent ribs 121; circumferential radial walls 134, 135 that form opposite side walls of each rib and that form junctures 138, 139 with the base surface portions 132; and top walls or surfaces 142 that extend between the side walls the full circumferential length of the ribs. The radial walls of each rib are flat and uniformly spaced from each other along the circumferential length of the ribs. The top walls or surfaces are concave so as to form sharp junctures 144, 145 with the sidewalls 134, 135, meeting at less than a 90 degree angle with the adjacent side wall. In the embodiment shown in FIG. 7, the sharp junctures have a radius of no more than 0.005 inch. Also in the embodiment of FIG. 7 the top walls or surfaces are each formed by two converging frusto-conical wall portions **142*a*, 142*b* that meet midway between the sidewalls 134, 135 at a 90** degree angle.

To provide an especially effective grip, it is preferred that the spaces between adjacent ribs, which are formed by the base surface portions 132, be of greater dimension in the axial direction than the axial thickness of the ribs (i.e., the distance between the walls 134, 135 of a rib) and that the height of the ribs (i.e., the radial dimension of the sidewalls) from the surface portions 132 be no greater than and preferably less than the axial thickness of the ribs so the ribs will have good resistance to axial distortion under load. In a preferred embodiment, the height of the ribs is ⅔ the axial thickness.

An especially suitable material that provides the desirable characteristics of the cover is natural rubber, i.e., later having a Durometer value of 35.

Because the elastomeric material of which the cover is made readily stretches and returns to its original dimensions, the diameter or circumferential dimensions should be chosen so the cover is in a stretched condition peripherally when applied to a handle. This and a relatively high coefficient of friction of the cover material assure a high resistance to slippage between the cover and the handle to which it is applied. As a result, a cover of the general shape shown in FIG. 7 can be applied to a handle that is of different shape from the cover, e.g., a handle 50 of the so-called "hour-glass" shape provided on a power-driven knife 52, shown in FIG. 6, as long as the variations in handle diameter along the length of the handle do not exceed the ability of the cover material to stretch sufficiently to both accommodate the largest diameter portion and to be under tension over the smallest diameter portion.

To assure flexibility yet adequate strength for the cover, when made of thin elastomeric material that will readily conform to the contour of a handle to which the cover is applied, the wall thickness of the cover at the base surface portions 132 is no less than 75% of the height of the ribs and typically is no greater than the height of the ribs.

Figure 10:
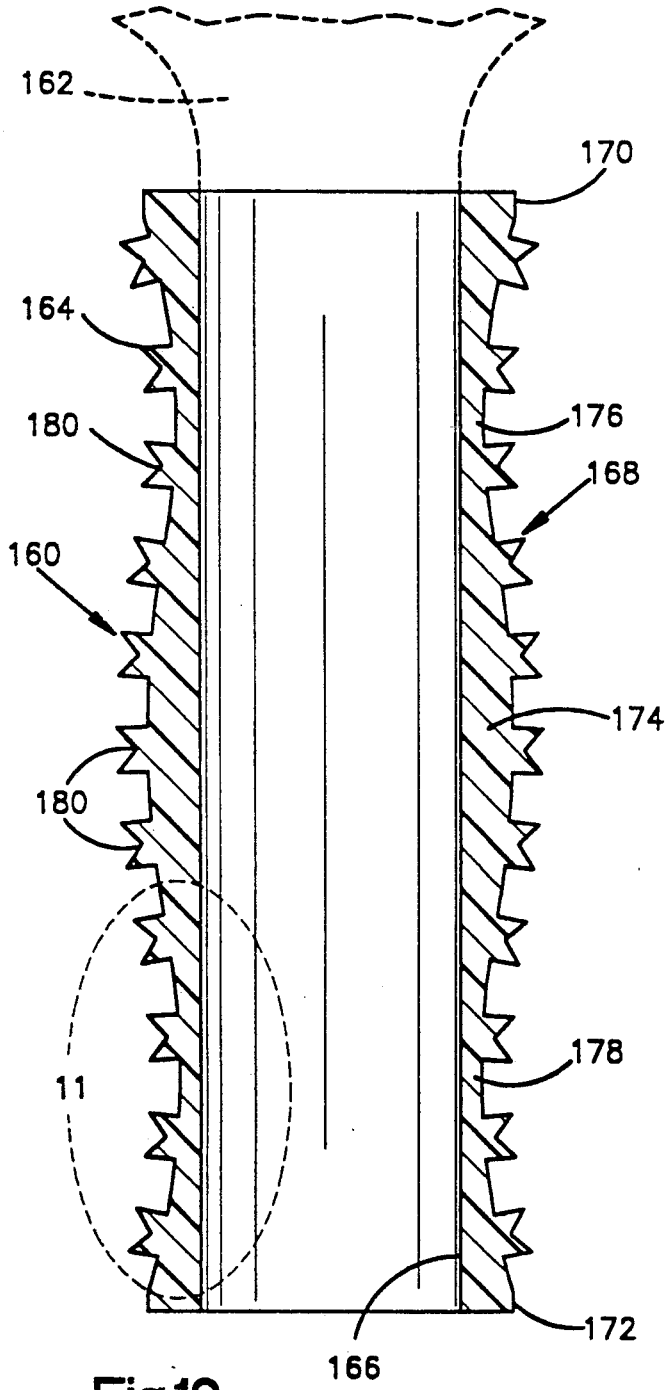
Figure 11:
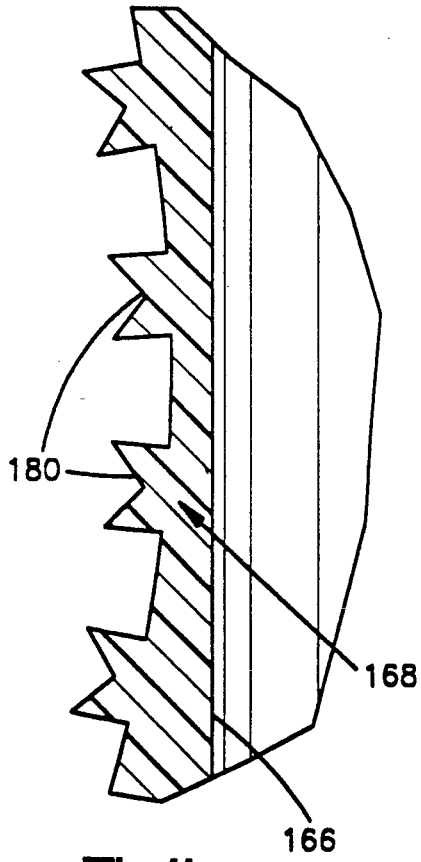

Another contoured-wall, ribbed, cover of the invention is shown generally at 160 on a handle 162 shown in phantom in FIG. 10. The contoured-wall cover is formed by molding liquified elastomeric material in a contoured-wall-cover-forming mold. The elastomeric material may be a natural rubber latex, such as Surtex Natural Rubber Latex which is U.S.D.A. Approved. The exterior surface 164 of the contoured-wall cover 160 is of the so-called hour-glass shape while the interior surface 166 is shaped to fit closely on the handle 162, which is cylindrical in shape in the embodiment shown. The hour-glass-like shape of the exterior surface 164 is formed by varying the thickness of a solid wall portion 168 from about ¼" at one end 170 and the other end 172 to about ⅜" at the hour-glass bulge 174 about half way between the ends, with a thickness of about ⅛" at a first waist 176 and at a second waist 178 on opposite sides of the bulge. Circumferential ribs, as at 180, are substantially of the same shape, relative spacing and height above base space portions, as the ribs 121. The contoured-wall cover 160 is sufficiently rigid to be slipped over and onto a handle, such as the handle 162. One advantage of the hour glass shape is that the thickness of the bulge 174 at the middle may be varied to accommodate different operator hand sizes for the same diameter handle. Another advantage of the hourglass shape is the provision of a relatively thick, i.e., about ⅛ of an inch at the thinnest waist portions, layer of elastomeric material beneath the ribs 180 to enhance the cushioning and shock absorbency of the cover.

From the foregoing description of the preferred embodiments of the invention it will be apparent that the advantages of the invention heretofore enumerated and others have been accomplished and that there has been provided new and useful handle covers. While preferred embodiments of the invention have been described in detail, various modifications or alterations may be made therein without departing from the spirit or scope of the invention set forth in the appended claims.

We claim:

1. A cover for a handle, comprising an elastomeric tube open at one end, said tube having integral ribs on an outside surface of and extending along the length of the tube, said ribs each having sidewalls extending a height from the outside surface, a top wall extending between the sidewalls forming a concave outer surface of the ribs that is shallower than the height of the ribs, and sharp edges where the top wall and the sidewalls edges meet.

2. A cover as set forth in claim 1 wherein the concave outer surface of the top wall of the ribs is formed of two flat surfaces intersecting midway between the sidewalls.

3. A cover as set forth in claim 2 wherein the two flat surfaces intersect at an angle of approximately 90 degrees.

4. A cover as set forth in claim 1 wherein the ribs are of uniform width and the distance between adjacent ribs is greater than the width of the ribs.

5. A cover as set forth in claim 1 wherein the sidewalls of the ribs are flat and parallel.

6. A cover as set forth in claim 1 wherein the width of the ribs is greater than their height.

7. A cover as set forth in claim 1 wherein the tube is formed of latex having a durometer value of approximately 35.

8. A cover as set forth in claim 1 wherein the tube is formed of a thin wall in the areas between the ribs and the height of the ribs is at least as great as the thickness of the thin wall.

9. A cover as set forth in claim 8 wherein the wall thickness in areas between the ribs is approximately 0.03 to 0.04 inch.

10. A cover for a handle, comprising an elastomeric tube open at one end, said tube having integral ribs on an outside surface of the tube, said ribs each having sidewalls extending from the outside surface, and a top wall extending between the sidewalls forming an outer surface of the ribs, characterized in that the outer surface of the ribs is concave, the junctures of the top wall and the sidewalls have sharp edges, the ribs extend lengthwise of the tube, are of uniform width, the width is greater than the height, and the distance between adjacent ribs is greater than the width of the ribs.

11. A cover as set forth in claim 10 further characterized in that the tube is formed of latex and has a wall thickness in areas between the ribs of approximately 0.03 to 0.04 inch and wherein the height of the ribs is at least as great as the wall thickness.

12. In combination, a cutting tool having a handle and a cover on the handle, said cover characterized by:

a non-slip surface to facilitate hand gripping under moist or oleaginous conditions;

resilience sufficient to provide cushioning against mechanical shock being transmitted from the handle to the hand during use;

reversible adherence to the handle to provide for non-twisting of the cover during use of the handle and further to provide for removal or replacement of the cover after use;

elasticity sufficient to provide for dimensional modification of the cover so that it contacts substantially the entire surface of the handle over which it lies;

non-permeability to prevent fluid substances from passing through the cover to the handle; and low thermal conductivity to provide insulation against heat being conducted away from the hand to the handle during use;

said cover comprising an elastomeric tube open at one end, said tube having a thin wall and integral ribs on an outside surface of and extending along the length of the tube, said ribs each having sidewalls extending from the outside surface, and a top wall extending between the sidewalls forming an outer surface of the ribs, substantially the entire outer surface of the ribs being concave and the junctures of the top wall and the sidewalls having sharp edges.

13. The combination of claim 12 further characterized by the cover being open at both ends.

14. The combination of claim 12 further characterized in that the ribs are of uniform width, the width is greater than the height, and the distance between adjacent ribs is greater than the width of the ribs.

15. An elastomeric cover for a handle constructed to be applied by the user and readily removable for cleaning and replacement, said cover characterized by:

a non-slip surface to facilitate hand gripping under moist or oleaginous conditions;

resilience sufficient to provide cushioning against mechanical shock being transmitted from the handle to the hand during use;

reversible adherence to the handle to provide for non-twisting of the cover during use of the handle and further to provide for removal or replacement of the cover after use;

elasticity sufficient to provide for dimensional modification of the cover so that it contacts substantially the entire surface of the handle over which it lies;

non-permeability to prevent fluid substances from passing through the cover to the handle;

low thermal conductivity to provide insulation against heat being conducted away from the hand to the handle during use; and being in the form of an elongated hollow tube open at one end, the tube being formed by a wall that varies in thickness along the length of the tube, an inside surface of the wall being essentially formed of straight line elements and an outside surface of the wall undulating along its length;

said tube having integral ribs on an outside surface of the wall and extending lengthwise of the tube said ribs each having sidewalls and a top wall that extends between the sidewalls and forms an outer surface, substantially the entire outer surface being concave and the junctures of the top wall and the sidewalls having sharp edges.

16. The cover of claim 15 further characterized by the cover being open at both ends.

17. The cover of claim 15 further characterized in that the ribs extend lengthwise of the tube, are of uniform width, the width is greater than the height, and the distance between adjacent ribs is greater than the width of the ribs.

18. A cover for a handle, comprising an elastomeric tube open at one end, said tube having integral ribs on an outside surface of the tube, said ribs each having sidewalls extending from the outside surface, and a top wall extending between the sidewalls forming a concave outer surface of the ribs having two flat surfaces intersecting midway between the side walls at an angle of approximately 90 degrees, and the junctures of the top surface and the sidewalls having sharp edges.

19. A cover for a handle, comprising an elastomeric tube open at one end, said tube having integral ribs of uniform width on an outside surface of the tube, said ribs each having sidewalls extending from the outside surface, a top wall extending between the sidewalls forming an outer concave surface of the ribs, the distance between adjacent ribs being greater than the width of the ribs, and the junctures of the top surface and the sidewalls having sharp edges.

20. A cover for a handle, comprising an elastomeric tube open at one end, said tube having integral ribs on an outside surface of the tube, said ribs each having sidewalls that are flat and parallel extending from the outside surface, and a top wall extending between the sidewalls, forming an outer surface of the ribs that is concave and forming with the sidewalls junctures that have sharp edges.

21. A cover for a handle, comprising an elastomeric tube open at one end and formed of latex having a durometer value of approximately 35, said tube having integral ribs on an outside surface of the tube, said ribs each having sidewalls extending from the outside surface, and a top wall extending between the sidewalls, forming an outer surface of the ribs that is concave and forming with the sidewalls junctures that have sharp edges.

22. A cover for a handle, comprising an elastomeric tube open at one end, said tube having integral ribs on an outside surface of the tube, said ribs each having sidewalls extending from the outside surface, and a top wall extending between the sidewalls forming an outer surface of the ribs, characterized in that the outer surface of the ribs is concave at the junctures of the top wall and the sidewalls, which meet at an acute angle and form sharp edges.

23. A cover as set forth in claim 22 wherein the acute angle is approximately 45 degrees.

24. A cover for a handle, comprising an elastomeric tube open at one end, said tube having integral circumferential ribs located along an outside surface of the tube, said ribs each having sidewalls extending a height from the outside surface, a top wall extending between the sidewalls forming a concave outer surface of the ribs that is shallower than the height of the ribs, and sharp edges where the top wall and sidewalls meet.

25. A cover as set forth in claim 24 wherein the concave outer surface of the top wall of the ribs is formed of two converging circumferential surfaces intersecting midway between the sidewalls.

26. A cover as set forth in claim 25 wherein the two circumferential surfaces intersect at an angle of approximately 90 degrees.

27. A cover as set forth in claim 24 wherein the ribs are of uniform width and the distance between adjacent ribs is greater than the width of the ribs.

28. A cover as set forth in claim 24 wherein the sidewalls of the ribs are flat and parallel.

29. A cover as set forth in claim 24 wherein the width of the ribs is greater than their height.

30. A cover as set forth in claim 24 wherein the ribs are circular.

31. A cover as set forth in claim 24 wherein the tube is formed of latex having a durometer value of approximately 35.

32. A cover as set forth in claim 24 wherein the tube is formed of a thin wall in the areas between the ribs and the height of the ribs is at least as great as the thickness of the thin wall.

33. A cover as set forth in claim 32 wherein the wall thickness in areas between the ribs is approximately 0.03 to 0.04 inch.

34. A cover for a handle, comprising an elastomeric tube open at one end, said tube having integral ribs on an outside surface of the tube, said ribs each having sidewalls extending from the outside surface, and a top wall extending between the sidewalls forming an outer surface of the ribs, characterized in that the outer surface of the ribs is concave, the junctures of the top wall and the sidewalls have sharp edges, the ribs extend circumferentially about the tube, are of uniform width, the width is greater than the height, and the distance between adjacent ribs is greater than the width of the ribs.

35. A cover as set forth in claim 34 further characterized in that the tube is formed of latex and has a wall thickness in areas between the ribs of approximately 0.03 to 0.04 inch and wherein the height of the ribs is at least as great as the wall thickness.

36. In combination, a cutting tool having a handle and a cover on the handle, said cover characterized by:

a non-slip surface to facilitate hand gripping under moist or oleaginous conditions;

resilience sufficient to provide cushioning against mechanical shock being transmitted from the handle to the hand during use;

reversible adherence to the handle to provide for non-twisting of the cover during use of the handle and further to provide for removal or replacement of the cover after use;

elasticity sufficient to provide for dimensional modification of the cover so that it contacts substantially the entire surface of the handle over which it lies;

non-permeability to prevent fluid substances from passing through the cover to the handle; and low thermal conductivity to provide insulation against heat being conducted away from the hand to the handle during use;

said cover comprising an elastomeric tube open at one end, said tube having a thin wall and integral circumferential ribs located along an outside surface of the length of the tube, said ribs each having sidewalls extending from the outside surface, and a top wall extending between the sidewalls forming an outer surface of the ribs, substantially the entire outer surface of the ribs being concave and the junctures of the top wall and the sidewalls having sharp edges.

37. The combination of claim 36 further characterized by the cover being open at both ends.

38. The combination of claim 36 further characterized in that the ribs are of uniform width, the width is greater than the height, and the distance between adjacent ribs is greater than the width of the ribs.

39. An elastomeric cover for a handle constructed to be applied by the user and readily removable for cleaning and replacement, said cover characterized by:

a non-slip surface to facilitate hand gripping under moist or oleaginous conditions;

resilience sufficient to provide cushioning against mechanical shock being transmitted from the handle to the hand during use;

reversible adherence to the handle to provide for non-twisting of the cover during use of the handle and further to provide for removal or replacement of the cover after use;

elasticity sufficient to provide for dimensional modification of the cover so that it contacts substantially the entire surface of the handle over which it lies;

non-permeability to prevent fluid substances from passing through the cover to the handle;

low thermal conductivity to provide insulation against heat being conducted away from the hand to the handle during use; and being in the form of an elongated hollow tube open at one end, the tube being formed by a wall that varies in thickness along the length of the tube, an inside surface of the wall being essentially formed of straight line elements and an outside surface of the wall undulating along its length;

said tube having integral circumferential ribs located along an outside surface of the wall, said ribs each having sidewalls and a top wall that extends between the sidewalls and forms an outer surface, substantially the entire outer surface being concave and the junctures of the top wall and the sidewalls having sharp edges.

40. The cover of claim 39 further characterized by the cover being open at both ends.

41. The cover of claim 39 further characterized in that the ribs are of uniform width, the width is greater than the height, and the distance between adjacent ribs is greater than the width of the ribs.

42. A cover for a handle, comprising an elastomeric tube open at one end, said tube having integral circumferential ribs on an outside surface of the tube, said ribs each having sidewalls extending from the outside surface, and a top wall extending between the sidewalls forming a concave outer surface of the ribs having two converging circumferential surfaces intersecting midway between the side walls at an angle of approximately 90 degrees, and the junctures of the top surface and the sidewalls having sharp edges.

43. A cover for a handle, comprising an elastomeric tube open at one end, said tube having integral circumferential ribs of uniform width on an outside surface of the tube, said ribs each having sidewalls extending from the outside surface, a top wall extending between the sidewalls forming an outer concave surface of the ribs, the distance between adjacent ribs being greater than the width of the ribs, and the junctures of the top surface and the sidewalls having sharp edges.

44. A cover for a handle, comprising an elastomeric tube open at one end, said tube having circumferential integral ribs on an outside surface of the tube, said ribs each having sidewalls that are flat and parallel extending from the outside surface, and a top wall extending between the sidewalls, forming an outer surface of the ribs that is concave and forming with the sidewalls junctures that have sharp edges.

45. A cover for a handle, comprising an elastomeric tube open at one end and formed of latex having a durometer value of approximately 35, said tube having circumferential integral ribs on an outside surface of the tube, said ribs each having sidewalls extending from the outside surface, and a top wall extending between the sidewalls, forming an outer surface of the ribs that is concave and forming with the sidewalls junctures that have sharp edges.

46. A cover for a handle, comprising an elastomeric tube open at one end, said tube having circumferential integral ribs on an outside surface of the tube, said ribs each having sidewalls extending from the outside surface, and a top wall extending between the sidewalls forming an outer surface of the ribs, characterized in that the outer surface of the ribs is concave at the junctures of the top wall and the sidewalls, which meet at an acute angle and form sharp edges.

47. A cover as set forth in claim 46 wherein the acute angle is approximately 45 degrees.

* * * * *

UNITED STATES PATENT AND TRADEMARK OFFICE

CERTIFICATE OF CORRECTION

PATENT NO. : 5,097,566

DATED : March 24, 1992

INVENTOR(S) : Richard B. Decker and Joseph Hummel

It is certified that error appears in the above-identified patent and that said Letters Patent is hereby corrected as shown below:

Column 3, line 43, before "The" insert --.--.

Column 3, line 46, after "that" delete --1--.

Column 4, line 33, after "good" insert -- strength, elasticity and capable of effectively--.

Column 5, line 63, delete "later" and insert --latex--.

Column 6, line 32, delete "!64" and insert --164--.

Signed and Sealed this

Twenty-second Day of June, 1993

*Attest:*

Michael K. Kirk

MICHAEL K. KIRK

*Attesting Officer*

*Acting Commissioner of Patents and Trademarks*